US006830150B1

(12) United States Patent
Cyr

(10) Patent No.: US 6,830,150 B1
(45) Date of Patent: Dec. 14, 2004

(54) POCKET FOR CARRYING REUSABLE ITEMS AND HAVING MEANS FOR DETERMINING WHICH OF THE REUSABLE ITEMS CONTAINED THEREIN HAVE BEEN USED OR NOT USED

(75) Inventor: Ryan Cyr, Hidden Hills, CA (US)

(73) Assignee: Tamrac, Inc., Chatsworth, CA (US)

( * ) Notice: Subject to any disclaimer, the term of this patent is extended or adjusted under 35 U.S.C. 154(b) by 195 days.

(21) Appl. No.: 10/080,461

(22) Filed: Feb. 21, 2002

(51) Int. Cl.[7] ..... B65D 85/00; B65D 85/57

(52) U.S. Cl. ..... 206/459.1; 206/308.1; 383/39

(58) Field of Search ..... 206/459.1, 425, 206/449, 307, 307.1, 308.1; 383/38–40, 42, 61.1, 61.5, 62, 84, 98, 99

(56) References Cited

U.S. PATENT DOCUMENTS

| | | | | | |
|---|---|---|---|---|---|
| 259,410 | A | * | 6/1882 | Marmaduke | 383/39 |
| 770,854 | A | * | 9/1904 | Corfman | 383/39 |
| 2,625,261 | A | | 1/1953 | Swift | |
| 4,960,204 | A | * | 10/1990 | Young et al. | 383/39 |
| 5,237,601 | A | | 8/1993 | Boutet et al. | |
| 5,238,305 | A | * | 8/1993 | Feller | 383/39 |
| 5,360,215 | A | * | 11/1994 | Ruben | 383/38 |
| 5,497,879 | A | | 3/1996 | Kao | |
| 5,588,527 | A | | 12/1996 | Youngs | |
| 5,588,528 | A | * | 12/1996 | Ozeki | 206/308.1 |
| 5,628,399 | A | | 5/1997 | Engen | |
| 5,772,020 | A | | 6/1998 | Hara | |
| 5,779,033 | A | * | 7/1998 | Roegner | 383/40 |
| 5,794,772 | A | | 8/1998 | Makinen et al. | |
| D428,755 | S | | 8/2000 | Bergh | |
| D434,262 | S | | 11/2000 | Bergh et al. | |
| 6,149,003 | A | * | 11/2000 | Day | 206/449 |
| 6,223,897 | B1 | * | 5/2001 | Bordes | 206/425 |
| 6,230,885 | B1 | | 5/2001 | Rochelo et al. | |

FOREIGN PATENT DOCUMENTS

| | | |
|---|---|---|
| WO | WO96/41758 | 12/1996 |

* cited by examiner

*Primary Examiner*—Luan K. Bui
(74) *Attorney, Agent, or Firm*—Thomas I. Rozsa; Tony D. Chen

(57) ABSTRACT

A storage container, pouch, panel or part of a bag for carrying reusable items such as recording medium cartridges, rechargeable batters, or other reusable media and having an indicating flag for determining which of the reusable items contained within the containers have been used or not used. The container comprises a plurality of pockets, wherein each pocket has an indicating flag which is attached to the lining of the pouch. The pockets enable the reusable items to be stored therein and then the indicating flag is then moved out of the pocket so that it is exposed over the cartridge, so that the user knows that the reusable item has already been used and has no additional storage capacity or knows not to reuse it to record over it unless they intend to do so.

9 Claims, 3 Drawing Sheets

POCKET FOR CARRYING REUSABLE ITEMS AND HAVING MEANS FOR DETERMINING WHICH OF THE REUSABLE ITEMS CONTAINED THEREIN HAVE BEEN USED OR NOT USED

BACKGROUND OF THE INVENTION

1. Field of the Invention

The present invention relates generally to the field of containers. More particularly, the present invention relates to the field of media storage pockets, panels or a part of a bag for carrying reusable items such as recording medium cartridges therein.

2. Description of the Prior Art

Specifically, media storage pouches are well known in the art. These media storage pouches are used for carrying reusable cartridges therein. Typically, people often do not remember whether they have used a particular cartridge and therefore, it is possible that they may inadvertently record over the same cartridge, thereby destroying valuable photographs or have the cartridge rendered unsafe because its memory is full. However, none of the prior arts disclose an indicating means capable of being tucked under the reusable items and then placed outside of the pocket and over the reusable items after it has been used.

The following eleven (11) prior art references are found to be pertinent to the field of the present invention:

1. U.S. Pat. No. 2,625,261 issued to Swift on Jan. 13, 1953 for "Fisherman's Fly Book" (hereafter the "Swift Patent");
2. U.S. Pat. No. 5,237,601 issued to Boutet et al. on Aug. 17, 1993 for "Radiographic Cassette Having Coding For Identifying Exposed And Unexposed Film" (hereafter the "Boutet Patent");
3. U.S. Pat. No. 5,497,879 issued to Kao on Mar. 12, 1996 for "Film Status Cap" (hereafter the "Kao Patent");
4. U.S. Pat. No. 5,588,527 issued to Youngs on Dec. 31, 1996 for "Storage Container With Integral Flap" (hereafter the "Youngs Patent");
5. U.S. Pat. No. 5,628,399 issued to Engen on May 13, 1997 for "Indicating CD Case Insert" (hereafter the "Engen Patent");
6. U.S. Pat. No. 5,772,020 issued to Hara on Jun. 30, 1998 for "Sheet For Holding Information Recording Carriers" (hereafter the "Hara Patent");
7. U.S. Pat. No. 5,794,772 issued to Makinen et al. on Aug. 18, 1998 for "Container For Recordable Digital Optical Discs With Window And Scale For Determining Available Space" (hereafter the "Makinen Patent");
8. U.S. Pat. No. 6,230,885 issued to Rochelo et al. on May 15, 2001 for "Memory Card Protective Carrier" (hereafter the "Rochelo Patent");
9. U.S. Design Pat. No. 428,755 issued to Bergh on Aug. 1, 2000 for "Storage Wallet For Cassettes" (hereafter "the '755 Bergh Patent");
10. U.S. Design Pat. No. 434,262 issued to Bergh et al. on Nov. 28, 2000 for "Sleeve For Holding Digital Video Discs With A Write-On Title Strip" (hereafter "the '262 Bergh Patent"); and
11. Patent Cooperation Treaty (PCT) No. WO 96/41758 issued to Hara for "Holding Sheet For Information Recording Media" (hereafter "the '758 PCT").

The Swift Patent discloses a fisherman's fly book which is a storage book having separate compartments with visual identifiers. It provides for visual identification and selection of the flies of each type and to provide protection against damage of the files until they are removed for use. The storage book comprises a plurality of transversely across spaced slits which form pockets and a removable envelope is carried in each pocket which has identification markings thereto.

The Boutet Patent discloses a radiographic cassette having coding for identifying exposed and unexposed film. This is accomplished by color coding two adjacent side edges of the cassette with color different from the other side edges of the cassette.

The Kao Patent discloses a film canister having a status cap for indicating if the film is either exposed or unexposed.

The Youngs Patent discloses a storage container for a single compact disc. The container is provided with an integral flap for access to the storage compartment which holds the compact disc.

The Engen Patent discloses a compact disc case insert having a colored flag for indicating that the case is empty. The case has a slot in the edge of the tray which has the colored flag in the form of a spring loaded clip. When a disc is inserted into the case, the clip is pushed against the low tension of a spring attached to the clip. When the clip is removed by the insertion of a disc, the colored flag appears in a window in the case. When the disc is removed, the spring moves the flag so it is not visible, indicating that the case is empty.

The Hara Patent discloses a plastic sheet for holding information recording carriers in the form of small floppy disks. It includes a removable index strip from the bottom of the sheet and mounting it by inserting it into the insertion groove on top of the sheet for identifying the information recording carriers contained in the holding cavities in the holding sheet.

The Makinen Patent discloses a container for recordable digital optical discs with window and scale for determining available space.

The Rochelo Patent discloses a memory card protective carrier for carrying memory cards and for protecting data transfer ports of the cards. It comprises an indexing strip for identifying the carrier.

The '755 Bergh Patent discloses a storage wallet for cassettes.

The '262 Bergh Patent discloses a sleeve for holding digital video discs with a write-on title strip.

The '758 PCT discloses a holding sheet for an information recording media. This '758 PCT corresponds to the Hara Patent issued on Jun. 30, 1998.

It is desirable to provide a medium storage pocket, panel or part of a bag having indicating means for determining which of the reusable items such as recording medium cartridges contained therein has been used or not used in a much more efficient way, with which the user can avoid this significant disadvantage in the prior art.

SUMMARY OF THE INVENTION

The present invention is a medium storage pocket, panel or part of a bag for carrying reusable items such as recording medium cartridges, rechargeable batteries, etc. and having means for determining which of the items contained within the pouch have been used or not used.

The medium storage pocket comprises a plurality of separate indicating means, each comprising a red indicating flag which is sewn into the lining of the pocket which is designed to carry reusable items such as reusable recording medium cartridges. Accordingly, the invention enables the items to be stored in the pocket. The indicating flag is then moved out of the pocket so that it is exposed over the cartridge and in this way the user knows that the item has already been used and therefore, will not inadvertently reuse it and record over it unless they intend to do so and the user will not attempt to use a medium that has no storage capacity available. Before the item such as the recording medium is used, the flag is within the pocket and tucked under the recording medium.

It is an object of the present invention to provide an item storage pocket which includes indicating means for determining which of the reusable items contained within the pockets of a carrying pouch have already been used or not used.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
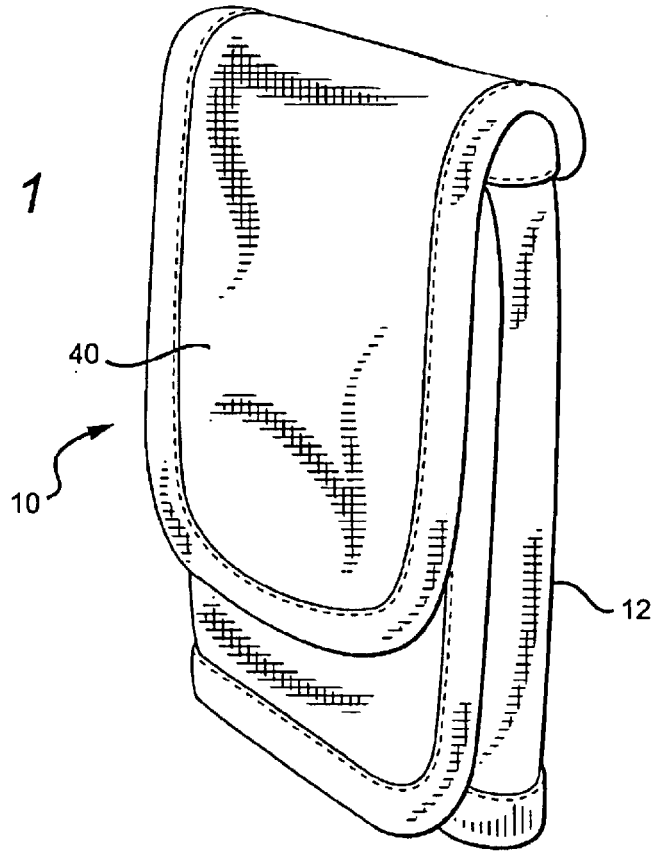
FIG. 1 is an enlarged front perspective view of a reusable item storage pouch or container in its closed condition in accordance with the present invention.

Referring to FIG. 1, there is shown at the present invention medium storage pouch, bag or container in its closed condition for carrying and storing reusable items which by way of example are reusable recording medium cartridges therein (shown in dashed lines, see FIG. 2) such as cassette tapes, compact discs, digital camera recording mediums such as compact flash, smart media, memory stick, multimedia, microdrive and PC cards, rechargeable batteries or any reusable item (defined cumulatively as reusable items). The pouch or container 10 may be constructed from Cordura® nylon material, a cotton duck material, or any suitable material that can readily be sewn for convenience in manufacturing. However, it will be understood that other materials may be utilized in the construction of the pouch or container 10. The pouch or container 10 is generally a substantially rectangular shaped structure in its closed condition, but it may be a square, oval, round or any other shape if desired.

Figure 2:
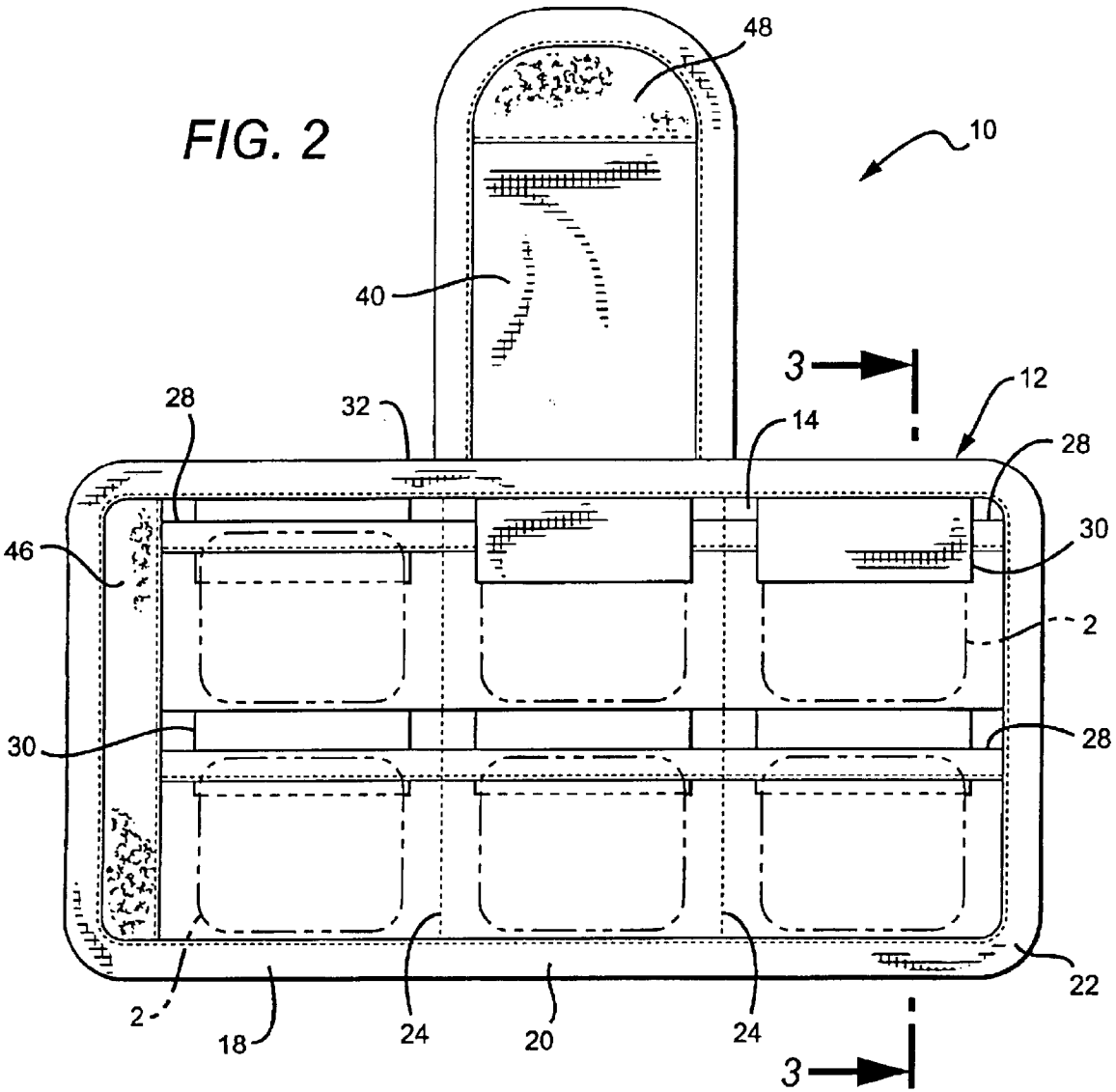
FIG. 2 is a front elevational view of the present invention reusable item storage pouch or container in its open condition, showing two flag indicators over two of the pockets and the other flag indicators being tucked underneath the reusable items stored in the pockets of the storage pouch.

Referring to FIGS. 1 and 2, the pouch or container 10 includes an elongated foldable panel 12 which is foldable in its widthwise direction and is made from a flexible sheet of material. The foldable panel 12 includes an interior surface 14 and an exterior surface 16. The foldable panel 12 forms three sections which include a left section 18, a middle section and a right section 22, where the right and left sections and 22 are foldable by fold lines 24 onto the middle section 20 as shown in FIG. 1. A plurality of small pockets 26 are attached to the interior surface 14 of the panel 12 for storing and carrying reusable items 2 therein, which reusable items can be cassette tapes, compact discs, digital camera recording medium, rechargeable batteries, etc. There are at least two pockets 26 for each section of the foldable panel 12. These pockets 26 are fitted in the customary manner by being sewn onto the interior surface 14 of the foldable panel 12. Each pocket 26 has fours sides, wherein three sides are sewn to the foldable panel 12 and the fourth side is a top opening 28 which is open to the pocket 26 for allowing the reusable item 2 to be inserted or removed from the pocket 26.

It will be appreciated that the plurality of pockets is not limited to six pockets as illustrated in FIG. 2. It is emphasized that while six pockets have been illustrated, it is also within the spirit and scope of the present invention to have one, two, three, four, five, six, seven, eight pockets or any other number of pockets.

Figure 3:
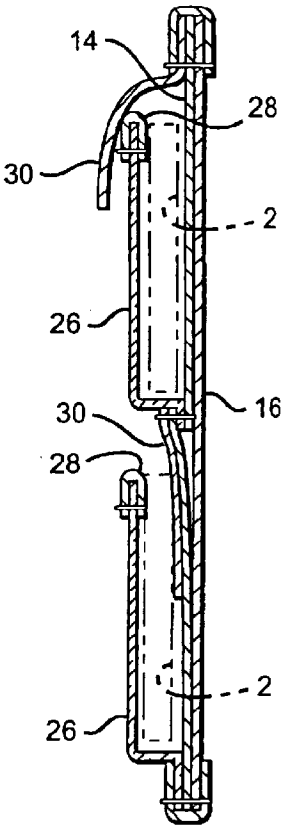
FIG. 3 is a cross sectional view taken along line 3—3 of FIG. 2.

Referring to FIGS. 2 and 3, there are provided indicating flags or means 30 which are respectively attached to the interior surface 14 by stitching and located adjacent to the top opening 28 of each pocket 26. Each indicating flag 30 can be moved over and cover the top opening 28 of the pocket 26 as shown or it can be tucked within the pocket 26 and underneath the cartridge 2. The function of the indicating flag 30 is to remind or indicate which one of the reusable items 2 contained within the pockets 26 has been used or not used by the user.

Figure 4:
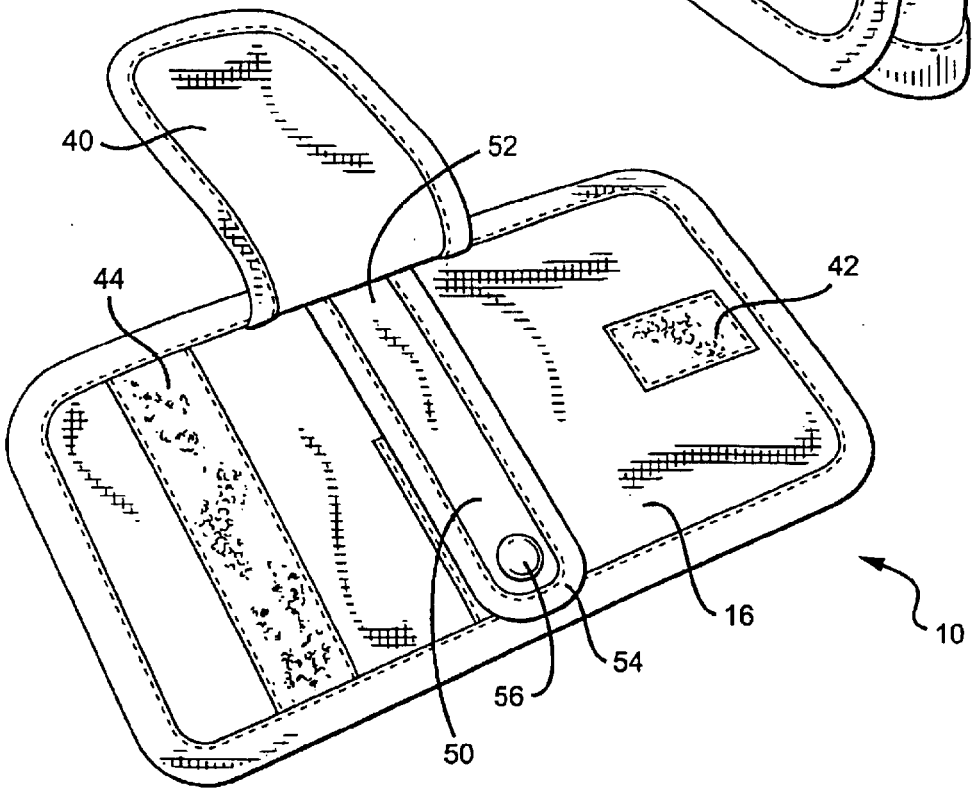
FIG. 4 is a rear perspective view of the reusable item storage pouch or container in its open condition in accordance with the present invention.

Referring to FIGS. 2 and 4, there is provided a flap 40 which is attached to an upper end 32 of the middle section 20 of the foldable panel 12 by stitching and can be folded downwardly to secure the three sections together (see FIG. 1). To secure the three sections 18, 20 and 22 together, fasteners 42, 44, 46 and 48 are provided in accordance with the present invention and are known in the art as Velcro® loop and hook type fasteners.

There is shown on the exterior surface 16 of the foldable panel 12, a small loop or hook type fastener 42 located on the left section 18 and a strip of loop or hook type fastener 44 on the right section 22. A mating strip of loop or hook type fastener 46 is located on the interior surface 14 of the foldable panel 12 and located on the left section 18 which corresponds and mates with the strip loop or hook type fastener 44. A mating loop or hook type fastener 48 is located on the flap 40 which corresponds and mates with the small loop or hook type fastener 42. There is further provided a strap 50 centrally located on the panel 12. The strap 50 has one end 52 sewn onto the exterior surface 16 of the 12 panel and a free end 54 which has a typical snap-on fastener 56 for securing the free end to the panel 12. The strap 50 may be used for securing the pouch 10 to a user's cloth or the like.

Accordingly, the present invention enables the reusable items 2 to be stored in the pocket 26 and then the indicating means 30 may be moved out of the pockets 26 of the pouch 10 so that it is exposed over the reusable item 2, so that the user knows that the reusable item 2 has already been used and to not reuse it such as to record over it unless they intend to do so.

The key novel feature of the present invention is the flexible indicating means 30 which can be tucked under the reusable item 2 to show the user that the reusable item 2 has not been used and can then be removed and placed over the reusable item 2 to show that the reusable item 2 has been used.

While the opening 28 of each pocket 26 has been shown in the top of the pocket 26 so the indicating means 30 is above the pocket 26, it will be appreciated that the opening can be on the lower end of the pocket so that the indicating means is beneath the pocket or the opening can be on either side edge of the pocket so that the indicating means is adjacent one side of the opening. In any of the embodiments, the indicating means 30 is beneath the reusable item 2 when the reusable item 2 is unused and above the reusable item 2 to show that it has been used.

It will be appreciated that the color of the indicating flag is not limited to red. It is emphasized that while the red color of the indicating flag 30 is preferred, it is also within the spirit and scope of the present invention to utilize other colors as desired.

The present invention conforms to conventional forms of manufacture or any other conventional way known to one skilled in the art.

Figure 5:
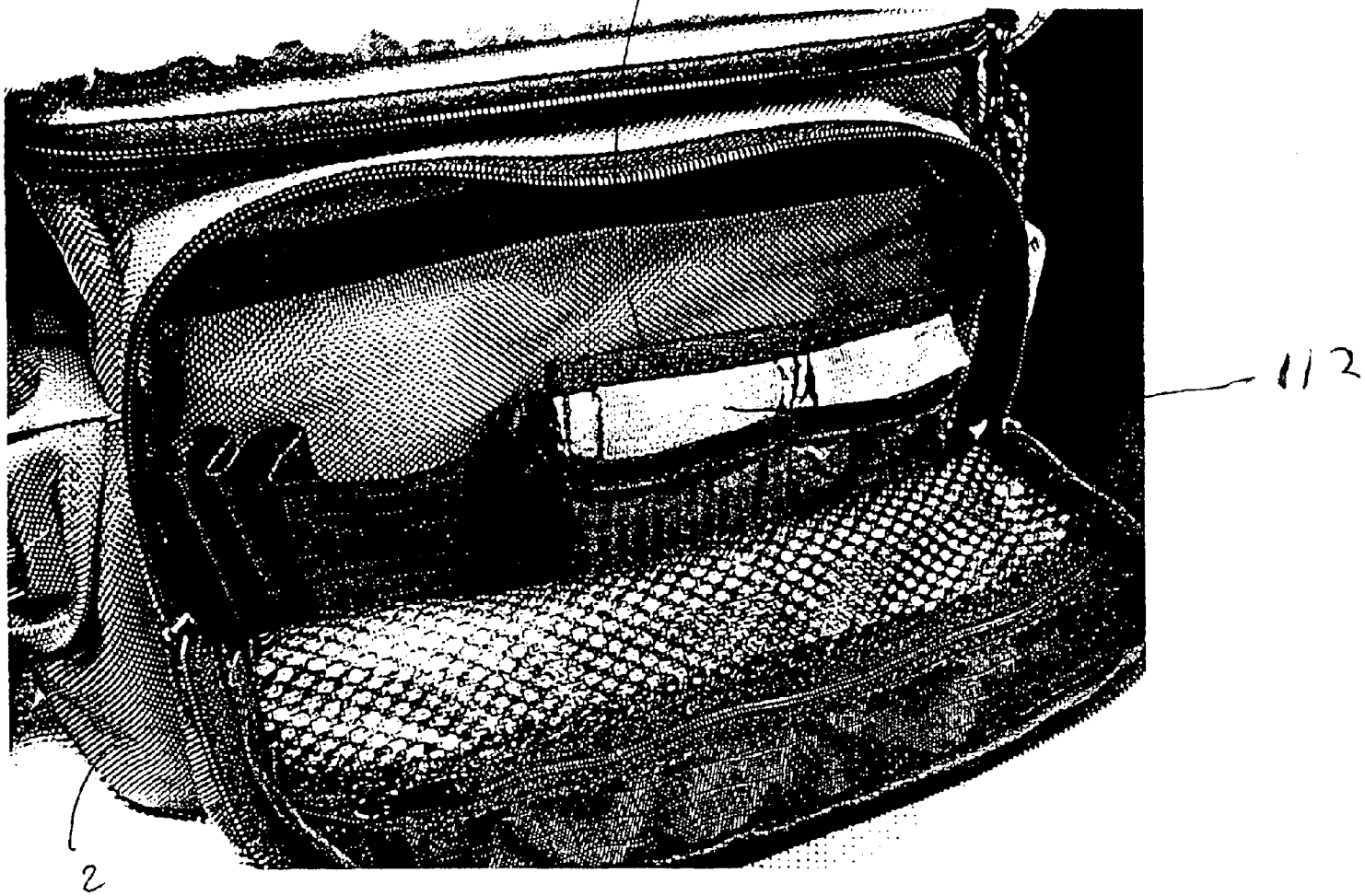
FIG. 5 is a perspective of an alterative embodiment of a reusable item pocket attached to a bag in accordance with the present invention.

Referring to FIG. 5, there is shown at 10 an alternative embodiment of the present invention pocket which is now shown as a pocket 110 that can be attached to the interior of a bag 2 by stitching means, Velcro® loop and hook type fasteners or any other suitable means. It will be appreciated that the embodiment shown in FIG. 5 is intended to illustrate the present pocket attached to any carrying type case such as the interior or exterior of a bag for carrying photographic items and cameras as illustrated in FIG. 5 or alternatively, any other type of carrying case or bag. It is within the spirit and scope of the present invention to have at least one pocket either permanently or removably affixed to either the interior or exterior of the carrying case or bag and having means for determining whether at least one reusable item such as a recording medium contained within the pouch has been used or not used which means is the indicating flag of the present invention wherein the indicating flag 112 can be tucked underneath the reusable item when the reusable item has not been used and is placed to lay over the reusable item when the reusable item has been used. The device consisting of at least one pocket assembles and functions the same as has previously been described for a multiplicity of pockets except that in its broadest form the present invention comprises at least one pocket 10 which has an indicating means 112 which functions the same as previously described indicating means 30. In the preferred embodiment the indicating means is a flag which can be tucked under the reusable item as previously illustrated when the reusable item has not been used and can be placed over the reusable item as previously illustrated when the reusable item has been used. While the present invention has been described as being used with a pocket for retaining the reusable item, it will be appreciated that the pocket can be substituted by a panel or a part of a bag or any other retaining means for retaining the reusable item in its interior or on its exterior. While the pocket is illustrated as being permanently affixed to the bag in FIG. 5, it will be appreciated that the pocket 110 can also be removably affixed by means of mating hook and loop fasteners or snaps, or any other means by which the pocket can be removably affixed.

Defined in detail, the present invention is a storage pouch for storing and carrying reusable items and having means for determining which of the reusable items contained therein have been used or not used, the storage pouch comprising: (a) a foldable panel made from a flexible sheet of material and having an interior surface and an exterior surface, the foldable panel forming three sections, where two of the three sections are foldable onto a stationary section; (b) a plurality of pockets for respectively retaining the reusable items, each pocket attached to said interior surface and having a top opening for accessing said each pocket; (c) a multiplicity of indicating flags wherein a respective indicating flag is respectively attached to said interior surface and located adjacent to said top opening of a respective one of said each pocket, where the indicating flag is movable to cover said top opening of said each pocket or tucked within said each pocket for respectively indicating which one of the reusable items contained therein have been used or not used; and (d) a flap attached to an upper end of said foldable panel and having means for securing the flap to said foldable panel to secure said three sections together in its closed condition; (e) whereby said pouch enables the reusable items to be stored therein by said plurality of pockets and in addition said indicating flag of said each pocket is either moved out of said each pocket to show that a reusable item has been used or tucked within said each pocket to show that the reusable item has not been used.

Defined broadly, the present invention is a storage pouch for storing and carrying reusable items and having means for determining which of the reusable items contained therein have been used or not used, the storage pouch comprising: (a) a foldable panel having an interior surface and an exterior surface, the foldable panel forming at least three sections, where two of the three sections are foldable onto a stationary section; (b) a plurality of pockets for respectively retaining the reusable items, each pocket attached to said interior surface and having an opening for accessing said each pocket; (c) an indicating flag respectively attached to said interior surface and located adjacent to said opening of said each pocket, where the indicating flag is movable to cover said opening of said each pocket or tucked within said each pocket for respectively indicating which one of the reusable items contained therein have been used or not used; and (d) a flap attached to said foldable panel and having means for securing the flap to said foldable panel to secure said three sections together in a closed condition; (e) whereby said pouch enables the reusable items to be stored therein by said plurality of pockets and in addition said indicating flag of said each pocket is either moved out of said each pocket to show that a reusable item has been used or tucked within said each pocket to show that the reusable item has not been used.

Defined more broadly, the present invention is a container for storing and carrying reusable items and having means for determining which of the reusable items contained therein have been used or not used, the container comprising: (a) a foldable panel having an interior surface and an exterior surface; (b) a plurality of pockets for respectively retaining the reusable items, each pocket attached to the interior surface and having an opening for accessing the each pocket; and (c) a multiplicity of indicating flags wherein a respective indicating flag is respectively attached to the interior surface and located adjacent to the opening of a respective one of the each pocket, where the indicating flag is movable to cover the opening of the each pocket or tucked within the each pocket for respectively indicating which one of the reusable items contained therein have been used or not used; (d) whereby the container enables the reusable items to be stored therein by the plurality of pockets and in addition the indicating flag of the each pocket is either moved out of the each pocket to show that a reusable item has been used or tucked within the each pocket to show that the reusable item has not been used.

Defined even more broadly, the present invention is a container for storing and carrying reusable items and having means for determining which of the reusable items contained therein have been used or not used, the container comprising: (a) a panel having at least one surface; (b) a plurality of pockets for respectively retaining the reusable items, each pocket attached to the at least one surface and having an opening for accessing the each pocket; and (c) a multiplicity of indicating means wherein a respective indicating means is respectively attached to the at least one surface and located adjacent to the opening of a respective one of the each pocket, where the indicating means respectively indicate which one of the reusable items contained therein have been used or not used.

Defined still even more broadly, the present invention is a container for storing and carrying at least one reusable item and having means for determining whether the at least one reusable item contained therein has been used or not used, the container comprising: (a) a panel having an interior surface and an exterior surface; (b) at least one pocket for retaining the reusable item, the at least one pocket attached to the interior surface and having an opening for accessing the at least one pocket; and (c) an indicating means attached to the interior surface and located adjacent to the opening of the at least one pocket, where the indicating means can be used to indicate whether the reusable item has been used or not used by having the indicating means placed under the reusable item if the reusable item has not been used and by having the indicating means placed so that it lies over the reusable item if the reusable item has been used.

Defined still even more broadly, the present invention is a container for storing and carrying at least one reusable item and having means for determining whether the at least one reusable item contained therein has been used or not used, the container comprising: (a) a panel having an interior surface and an exterior surface; (b) at least one pocket for retaining the reusable item, the at least one pocket attached to the exterior surface and having an opening for accessing the at least one pocket; and (c) an indicating means attached to the exterior surface and located adjacent to the opening of the at least one pocket, where the indicating means can be used to indicate whether the reusable item has been used or not used by having the indicating means placed under the reusable item if the reusable item has not been used and by having the indicating means placed so that it lies over the reusable item if the reusable item has been used.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A storage pouch for storing and carrying reusable items and having means for determining which of the reusable items contained therein have been used or not used, the storage pouch comprising:

a. a foldable panel made from a flexible sheet of material and having an interior surface and an exterior surface, the foldable panel forming three sections, where two of the three sections are foldable onto a stationary section and having first means for securing said two folded sections in a folded condition;

b. a plurality of pockets for respectively retaining the reusable items, each pocket attached to said interior surface and having a top opening for accessing said each pocket;

c. a multiplicity of indicating flags wherein a respective indicating flag is respectively attached to said interior surface and located adjacent to said top opening of a respective one of said each pocket, where the indicating flag is movable to cover said top opening of said each pocket or and is also sized to be narrower than said top opening of said each pocket so that it can be tucked within said each pocket for respectively indicating which one of the reusable items contained therein have been used or not used; and d. a flap attached to an upper end of said foldable panel and having additional second means for securing the flap to said foldable panel to secure said three sections together in its closed condition;

e. whereby said pouch enables the reusable items to be stored therein by said plurality of pockets and in addition said indicating flag of said each pocket is either moved out of said each pocket to show that a reusable item has been used or tucked within said each pocket to show that the reusable item has not been used.

2. The storage pouch in accordance with claim 1, wherein said first securing means and additional second securing means include loop and hook fasteners.

3. The storage pouch in accordance with claim 1, wherein said indicating flag is red color.

4. The storage pouch in accordance with claim 1, wherein said reusable item is a recording medium cartridge.

5. A storage pouch for storing and carrying reusable items and having means for determining which of the reusable items contained therein have been used or not used, the storage pouch comprising:

a. a foldable panel having an interior surface and an exterior surface, the foldable panel forming at least three sections, where two of the three sections are foldable onto a stationary section and having first means for securing said two folded sections into a folded condition;

b. a plurality of pockets for respectively retaining the reusable items, each pocket attached to said interior surface and having an opening for accessing said each pocket;

c. an indicating flag respectively attached to said interior surface and located adjacent to said opening of said each pocket, where the indicating flag is movable to cover said opening of said each pocket and is also sized to be narrower than said top opening of said each pocket so that it can be tucked within said each pocket for respectively indicating which one of the reusable items contained therein have been used or not used; and d. a flap attached to said foldable panel and having additional second means for securing the flap to said foldable panel to secure said three sections together in a closed condition;

e. whereby said pouch enables the reusable items to be stored therein by said plurality of pockets and in addition said indicating flag of said each pocket is either moved out of said each pocket to show that a reusable item has been used or tucked within said each pocket to show that the reusable item has not been used.

6. The storage pouch in accordance with claim 5, wherein said first securing means and additional second securing means include loop and hook fasteners.

7. The storage pouch in accordance with claim 5, wherein said indicating flag is red color.

8. The storage pouch in accordance with claim 5, wherein said foldable panel when folded is generally a rectangular shape.

9. The storage pouch in accordance with claim 5, wherein said reusable item is a recording cartridge.

* * * * *